United States Patent [19]

Sater et al.

[11] Patent Number: 5,060,555

[45] Date of Patent: Oct. 29, 1991

[54] SLIDE DECELERATOR FOR A FIREARM

[75] Inventors: Ghaleb A. Sater, East Longmeadow; Robert L. Constant, Westfield; W. David Lee, West Newton, all of Mass.

[73] Assignee: Smith & Wesson Corp., Springfield, Mass.

[21] Appl. No.: 501,476

[22] Filed: Mar. 30, 1990

[51] Int. Cl.[5] ..... F41A 3/78

[52] U.S. Cl. ..... 89/196; 89/198

[58] Field of Search ..... 89/163, 196, 198

[56] References Cited

U.S. PATENT DOCUMENTS

| | | | |
|---|---|---|---|
| 834,578 | 10/1906 | Johnson | 89/198 |
| 1,563,675 | 12/1925 | Tansley | 89/198 |
| 2,522,192 | 9/1950 | Porter | 89/198 |
| 2,627,686 | 2/1953 | Shockey | 89/198 |
| 2,831,404 | 4/1958 | Sampson et al. | 89/198 |
| 3,336,838 | 8/1967 | Wilson | 89/198 |
| 3,696,706 | 10/1972 | Seidel et al. | 89/196 |
| 3,748,959 | 7/1973 | Möller et al. | 89/132 |
| 3,756,121 | 9/1973 | Roy | 89/196 |
| 3,776,095 | 12/1973 | Atchisson | 89/198 |
| 3,901,125 | 8/1975 | Raville | 89/163 |
| 4,344,352 | 8/1982 | Yates et al. | 89/198 |
| 4,388,855 | 6/1982 | Sokolovsky | 89/198 |
| 4,485,723 | 12/1984 | Sarony | 89/163 |
| 4,522,107 | 6/1985 | Woodcock et al. | 89/196 |
| 4,754,689 | 7/1988 | Grehl | 89/196 |
| 4,974,493 | 12/1990 | Yeffman | 89/198 |

*Primary Examiner*—Stephen C. Bentley

*Attorney, Agent, or Firm*—Chapin, Neal & Dempsey

[57] ABSTRACT

Slide decelerator for a firearm has a cylindrical cavity formed in the metallic receiver of the firearm and a deformable mass of elastomeric material is disposed within the cavity. A piston is slidably fitted into the cavity and a rod extends outwardly from the piston for engagement with a depending portion of the slide. The elastomer consists of a cylindrical plug which has a diameter substantially smaller than the inner diameter of the cavity and an axial length approximately equal to that to the length of the cavity. Upon firing, the slide, being moved rearwardly by blow-back of combustion gases, will impact against the rod and elastomeric material will be deformed to thereby absorb the kinetic energy of the slide. As a result, the slide is stopped before impacting against the receiver of the firearm.

4 Claims, 1 Drawing Sheet

SLIDE DECELERATOR FOR A FIREARM

BACKGROUND OF THE INVENTION

This invention relates to a slide decelerator or arresting system for a firearm and, more particularly, to such a system as utilizes a deformable, energy absorbing elastomeric material.

For many years there have been various proposals for reducing the effect in firearms of the slide or bolt impacting against the frame of the gun, causing a substantial shock to the frame or handgrip or stock portion of the gun which, of course, impacts on the hand or body of the shooter.

Among the various means proposed, have been pneumatic cylinders, springs and shock absorbing materials and combinations of these components and materials. U.S. Pat. No. 1,563,675 to Tansley discloses the use of a series of resilient discs for absorbing some of the energy of recoil.

U.S. Pat. No. 2,522,192 to Porter teach us the use of a combination of recoil springs and a cylinder.

U.S. Pat. No. 3,756,121 to Roy discloses the use of a rod and buffer head 52 of Nylon, called "Zytel", to absorb the energy of impact between the slide and the frame.

U.S. Pat. No. 4,388,855 to Sokolovsky teaches the use of compressed air to resist the recoil forces.

U.S. Pat. No. 4,522,107 to Woodcock relates to a shock absorbing mechanism which comprises a "resilient sheet 44" of polypropylene disposed between two rigid plates for cushioning the impact of the slide.

U.S. Pat. No. 1,754,689 to Grehl discloses a recoil buffer similar to the '121 Patent, but which combines a spring guide and a head portion of a resilient plastic material having energy absorbing properties. This patent refers to the use of a Nylon material called "Delrin".

U.S. Pat. No. 4,344,352 to Yates teaches the use of recoil springs with a shock absorbing cap disposed at the forward ends of the spring to cushion the slide. The caps are slitted in such a manner that they will be resiliently deformed in response to axial forces imparted to the slide.

It will be apparent from the above-discussion, that while various means have been proposed for absorbing the energy of the slide, none has related to the use of an elastomeric material characterized by its ability to be deformed a substantial percentage of its size and to thereafter, upon release of the impacting force of the slide, to recover fully. Unlike the prior art, the elastomer used in the decelerator of this invention will be characterized by its superior rebound resilience, such that only a small amount (about 10%) of the energy absorbed by the elastomer in deformation will be returned to the slide. The energy absorbtion of the elastomer reduces the shock load to the frame and also reduces the momentum to the shooter.

It is the principal object of this invention to provide a novel decelerating system for the slide, bolt or other reciprocable part of a firearm.

It is another object of this invention to provide a novel slide decelerator of the above type which utilizes elastomeric material capable of absorbing the kinetic energy of the slide during the terminal portion of its rearward movement.

It is a further object of this invention to provide a slide decelerator of the above type which utilizes a tough, durable, solvent-resistant elastomer and which is capable of retaining its elastomeric properties even after being subjected to firing more than 10,000 rounds.

The above and other objects and advantages of this invention will be more readily apparent from the following description read in conjunction with the accompanying drawing in which.

Figure 1:
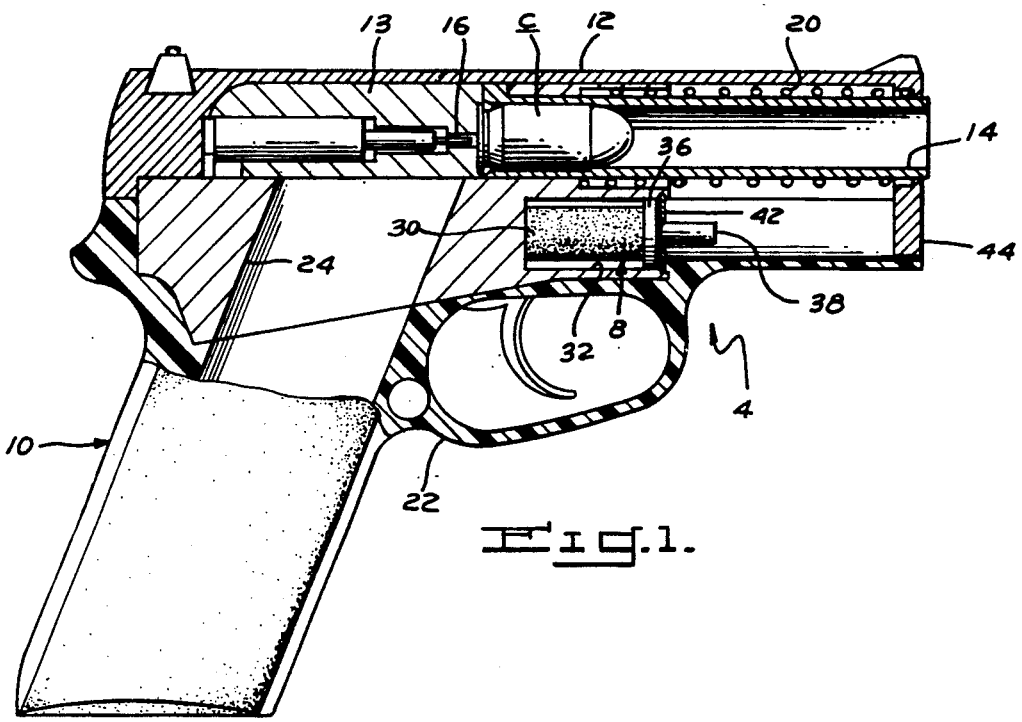
FIG. 1 is a side elevational view, partly in cross-section, showing a semi-automatic pistol equipped with a slide decelerator of the type embodying this invention.
Figure 2:
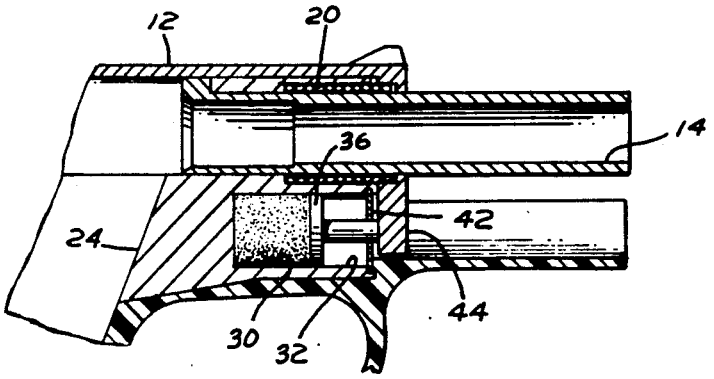
FIG. 2 is a partial elevational view showing the slide decelerator of FIG. 1, but with the parts thereof disposed in different operative relationship.

This invention is applicable to firearms which may be any type of automatic or semi-automatic rifle or pistol. In FIG. 1, the firearm is shown in the form of a semi-automatic handgun or pistol 4, such as a 9mm, 10mm, .40 caliber, or .45 caliber, equipped with a slide decelerating system or "decelerator" 8 of the type embodying this invention. The pistol includes a frame 10, a slide 12 and a breech block 13. The slide and breech block, being reciprocable, are adapted to pick up and feed cartridges c into the barrel 14 of the pistol. When a round is fired by the firing pin 16, the gases of combustion will propel the bullet toward the muzzle of the barrel 14 and impart an equal and opposite force of recoil to the handgun. In conventional fashion, blowback gases are used to move the breech block 13 and slide 12 rearwardly (FIG. 2) for cartridge case ejection and the reloading cycle.

Recoil spring 20, coiled about the barrel 14, is seated at its outer end against a shoulder of the slide and at its inner end against receiver 24. The recoil spring 20 serves primarily to return the slide to the firing position (FIG. 1), although, when compressed, it does absorb some of the kinetic energy of the slide 12.

While the slide decelerator or arresting system 8 may be used with a conventional firearm having a metal frame, it is especially adapted to be used in firearms in which a substantial portion of the frame or shroud 22, which includes the handle and trigger guard, is formed of a synthetic plastic material. Although such materials are selected to be tough, durable, solvent and abrasion-resistant, they tend to deteriorate when subjected to repeated impact by the slide. Fitted within the shroud 22, is a steel receiver 24 which supports the reciprocal action of the slide 12 in the breech block and houses the slide decelerator 8. The stationary portion of the pistol comprises the frame 10 which includes the shroud 22 and receiver 24. The reciprocable portion includes the slide 12 and breech block 13.

The slide decelerator 8 comprises an elastomeric material 30 disposed on a stationary part of the gun and, in the preferred embodiment, is fitted into a forwardly opening cylindrical cavity 32 formed within the forward end of the metal receiver 24. The elastomer 30 is preferably in the form of a cylindrical body or rod which has an axial length slightly less than the corresponding axial dimension of the cavity 32. The diameter of the rod 30 is substantially less than the inner diameter of the cavity 32 to allow for radial expansion of the elastomer as it functions to absorb kinetic energy of the slide. At its outer end, the rod 30 is secured to a cylindrical disc or plunger 36 adapted for a sliding fit within the cylinder. A rod 38 extends forwardly from the center of the plunger, a distance of approximately one-half the axial length of the elastomer 30. The plunger 36 and rod 38 may be integrally formed of a metallic material, such as carbon steel or stainless steel, or it may be alternatively formed of a high impact polymer.

Figure 3:
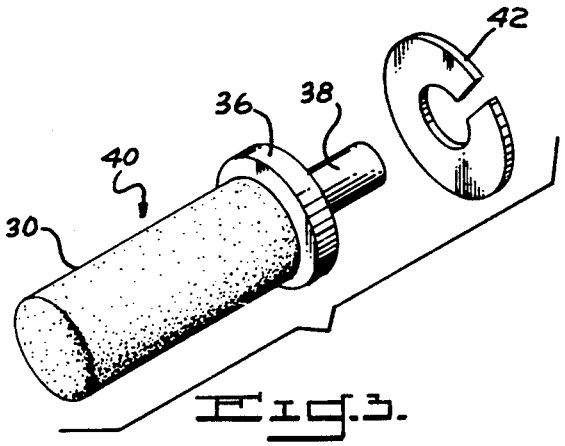
FIG. 3 is a perspective view showing an energy absorbing module used in the system embodying my invention.

As best depicted in FIG. 3, the elastomer 30, plunger 36 and rod 38 form a shock absorbing unitary module 40 adapted for easy assembly into the cylinder 32 of the receiver. A retaining ring 42 fits within an annular recess located adjacent the outer end portion of the cylindrical cavity 32 and serves to retain the module 40 in its assembled relation within the cavity of the receiver. When so assembled, the rod 38 will be disposed to be contacted by a depending flange or "chin" 44 of the slide 12 as the slide moves rearwardly.

Preferably, the elastomer is in the form of a cylindrical rod of high density material, such as a polyurethane, or the like, which will deform radially under an axially applied force whereby its volume before and after application of the axial force is approximately the same. When the gun is fired, the slide 12 will be moved rearwardly by blow-back gases, and chin 41 will contact the outer end of rod 38, a substantial distance forwardly of the receiver 24. As a result, the elastomer 30 will be deformed so that as its axial length diminishes, its diameter will increase proportionately until contacting the inner wall of the cavity 32. As a result, the kinetic energy of the slide will be decelerated to "zero", whereby the slide will be stopped before impacting against the frame 10, which, as shown, comprises metal receiver 24 and the plastic shroud 22.

Those skilled in the art will recognize that this invention, as mentioned above, is applicable not only for absorbing the kinetic energy of the slide of semi-automatic pistols, as described herein, but also may advantageously be used for the same purpose on automatic firearms, including rifles and shotguns having a reciprocable bolt instead of a slide.

Elastomers which would be suitable for use as a slide decelerator of the type embodying this invention, are those of which have the following physical properties: Shore A durometer hardness of 45–65 and Bashore rebound resilience of less than 30 percent.

The material would also have a compressive load deformation strength within the following ranges:

| Deformation | Load (lbs.) |
|---|---|
| 10% | 10–150 |
| 30% | 100–400 |
| 50% | 200–800 |

To be acceptable, the material must also be resistant to gun cleaning solvents, ozone and ultraviolet light and must still be functional within the temperature range of (−) 68° F. and 300° F. One such elastomer was test-fired 10,000 times in a .45 caliber pistol and was found to have lost none of its essential performance characteristics as a slide decelerator. Preferably, the material is also "viscoelastic" which means "velocity dependent", that is the ability to store energy of deformation in which the application of a stress gives rise to a strain that approaches equilibrium slowly. Thus, the higher the impact velocity of the slide, the higher will be the resistance of the elastomer to deformation. This is an important property since, in a semi-automatic pistol, the slide velocities are relatively high. In a .45 caliber semi-automatic pistol, for example, using an elastomer having the physical properties described, it has been found that the slide was stopped within approximately 0.5 inch of travel by an elastomer of approximately 1.0 inch in length and 0.5 inch in diameter disposed within a cylindrical cavity having an internal diameter of 0.7 inches.

Having thus described my invention, what is claimed is:

1. Slide decelerating system for a firearm, having a slide which has reciprocable stroke relative to the receiver of the firearm comprising an open ended cavity provided in said receiver, a deformable elastomeric material disposed within said cavity, a portion of said slide being carried toward the open end of said cavity, a plunger slidably disposed within said cavity against said elastomer, a rod extending forwardly from said plunger a predetermined distance so that its outer end is longitudinally spaced from said portion of the slide a distance substantially less than the length of the slide stroke so that during the terminal portion of the rearward movement of the slide, the plunger will substantially deform the elastomer to thereby absorb the kinetic energy of the slide during said terminal portion of its rearward stroke to cushion the impact of said slide relative to the receiver of said firearm, said elastomer being in the form of a rod and said cavity being of generally the same cross-sectional configuration as said rod but of substantially smaller diameter than said cavity to allow for radial expansion of the elastomeric rod commensurate with its deformation by the force of rearward movement of the slide thereagainst.

2. Slide decelerating system for a firearm, as set forth in claim 1, in which said elastomeric material is viscoelastic and has a Shore A durometer hardness in the range of 45–66 and a Bashore rebound resilience of less than thirty percent (30%).

3. Slide decelerating system for a firearm, as set forth in claim 1, in which said elastomeric material is polyurethane.

4. Slide decelerating system for a firearm, as set forth in claim 1, in which said firearm includes a frame comprising said receiver, which is formed of a metallic material and a shroud of synthetic plastic material.

* * * * *